US007418845B2

(12) United States Patent
Timothy

(10) Patent No.: US 7,418,845 B2
(45) Date of Patent: Sep. 2, 2008

(54) TWO-POINT MORTISE LOCK

(75) Inventor: E. Erik Timothy, Apollo Beach, FL (US)

(73) Assignee: Nationwide Industries, Tampa, FL (US)

( * ) Notice: Subject to any disclaimer, the term of this patent is extended or adjusted under 35 U.S.C. 154(b) by 303 days.

(21) Appl. No.: 11/162,874

(22) Filed: Sep. 27, 2005

(65) Prior Publication Data

US 2007/0068205 A1 Mar. 29, 2007

(51) Int. Cl.
*E05B 63/00* (2006.01)

(52) U.S. Cl. ..... 70/100; 70/121; 70/157; 292/26; 292/196

(58) Field of Classification Search ..... 70/99, 70/100, 121, 123, 157; 292/11, 26, 56, 46–48, 292/97, 213, 217, 196, DIG. 46
See application file for complete search history.

(56) References Cited

U.S. PATENT DOCUMENTS

| | | | | | |
|---|---|---|---|---|---|
| 416,181 | A * | 12/1889 | O'Keefe | 70/157 |
| 441,674 | A * | 12/1890 | Kubler | 70/82 |
| 559,296 | A * | 4/1896 | Lewis | 292/26 |
| 600,584 | A * | 3/1898 | Kaye | 70/100 |
| 1,047,900 | A * | 12/1912 | Voight | 292/336 |
| 1,216,765 | A * | 2/1917 | Anderson | 292/44 |
| 1,332,193 | A * | 3/1920 | Anderson | 292/26 |
| 1,515,550 | A * | 11/1924 | Christiaansen | 70/121 |
| 2,916,317 | A * | 12/1959 | Diday | 292/26 |
| 3,342,516 | A * | 9/1967 | Morand | 292/6 |
| 3,621,686 | A * | 11/1971 | Klein | 70/157 |
| 3,895,506 | A * | 7/1975 | Gallego | 70/168 |
| 3,899,201 | A * | 8/1975 | Paioletti | 292/25 |
| 5,820,170 | A * | 10/1998 | Clancy | 292/26 |
| 6,264,252 | B1 * | 7/2001 | Clancy | 292/196 |
| 6,672,632 | B1 * | 1/2004 | Speed et al. | 292/25 |
| 6,688,656 | B1 * | 2/2004 | Becken | 292/26 |
| 6,733,051 | B1 * | 5/2004 | Cowper | 292/196 |
| 6,776,441 | B2 * | 8/2004 | Liu | 292/26 |
| 7,178,839 | B2 * | 2/2007 | Tsai | 292/51 |

* cited by examiner

*Primary Examiner*—Suzanne D Barrett
(74) *Attorney, Agent, or Firm*—George R. McGuire; Bond Schoeneck & King, PLLC

(57) ABSTRACT

A mortise lock mechanism that includes a lock housing adapted for secure positioning within a mortise, first and second locking members positioned within the housing, each having a first end and a hooked second end, an actuator mounted for rotational movement within the housing and adapted for user directed rotational movement, and a motion translating linkage having a first end pivotally interconnected to the first end of the first locking member, a second end pivotally interconnected to the first end of the second locking member. The motion translating linkage is interconnected to the actuating member and adapted for corresponding movement when the actuator is moved. A first bias member interconnects the translating linkage to the housing, whereby the bias member retains the actuator and the translating linkage in a first position absent user force directed to the actuator.

21 Claims, 5 Drawing Sheets

TWO-POINT MORTISE LOCK

BACKGROUND OF THE INVENTION

1. Field

The present invention relates generally to mortise locks, and more particularly to two-point mortise locks used in connection with sliding doors.

2. Description of Art

Mortise locks are well known in the art. A mortise is cut into the edge of a sliding door and a lock devise is securely mounted therein. A keeper is then secured at a corresponding position on a door jamb. Typically, the mortise lock includes a single hook that is rotated between locked and unlocked positions by a snib (locking lever) which engages a cam located within the housing. In some applications a locking cylinder is used on the outside of the housing to actuate the lock mechanism. When the door is closed and the actuator is rotated, the hook rotates out of the lock housing and engages a ledge or other retention structure formed in the keeper, thereby fastening the door in locked relation to the jamb.

To unlock the door, the actuator is again rotated to disengage the hook from the ledge formed in the keeper. The door is then free to be moved relative to the jamb. When in the unlocked position, the hook is generally stowed within the lock housing that is fully positioned within the mortise formed in the edge of the door, thereby protecting the hook and preventing it from inadvertent damage or breakage by being slammed against the keeper or snagged by a person walking through the unlocked, open door.

In the patio door/sliding glass door manufacturing industry, the most commonly used mortise lock is the single point. There are many manufacturers of single point locks and they are all virtually the same. These single point locks are of a standard size, namely, 3¼ inches long (represented by "L" in FIGS. 2A and 2B), by ½ inch wide (represented as "W" in FIGS. 2A and 2C), by 1⅛ inches deep (represented by "D" in FIG. 2B). The cam location (where the snib enters the lock) has a backset (represented by distance "D1" in FIG. 2B) (defined as the distance from the backside of the face plate to the center of the cam) of ¾ inch and is located ⅞ inch from the end of the housing. Therefore, the locks that are manufactured for incorporation into these mortises are correspondingly sized. Because of this size constraint, generally a single lock (or hook) is incorporated into the mortise lock device. Due to the numerous moving parts involved in mortise locks, quality manufacture of single hook locks has been cost effective. Single point locks suffer the drawback, however, of being somewhat easily broken or disengaged by a fairly insignificant force, thus defeating the purpose for which the lock is used.

Multi-point mortise locks are commonly used in Europe and are larger than the single point mortise locks used in the U.S. Accordingly, the mortise locks in Europe are generally of larger dimensions than the single point mortise locks commonly used in the United States. Due to the larger mortise dimensions in Europe, it is an easier task to design a cost effective two-point locking device than in the United States, but the increased security achieved with a two-point lock versus the single point lock is significant.

3. Objects and Advantages

It is therefore a principal object and advantage of the present invention to provide a two-point mortise lock that is of the same dimensions as standard sized single point mortise locks in patio doors.

It is another object and advantage of the present invention to provide a two-point mortise lock that can be retrofit into existing mortises.

It is a further object and advantage of the present invention to provide a two-point mortise lock that is durable and can withstand repeated usage.

Other objects and advantages of the present invention will in part be obvious, and in part appear hereinafter.

SUMMARY OF THE INVENTION

In accordance with the foregoing objects and advantages, the present invention provides in a first aspect, a mortise lock mechanism, comprising: a lock housing adapted for secure positioning within a mortise; first and second locking members positioned within the housing, each having a first end and a hooked second end; an actuator mounted for rotational movement within the housing and adapted for user directed rotational movement; a motion translating linkage having a first end pivotally interconnected to the first end of the first locking member, a second end pivotally interconnected to the first end of the second locking member, the motion translating linkage being interconnected to the actuating member and adapted for corresponding movement when the actuator is moved; and a first bias member interconnecting the translating linkage to the housing, whereby the bias member retains the actuator and the translating linkage in a first position absent user force directed to the actuator. The mortise lock further comprises an anti-slam member mounted for pivotal movement within the housing; and a second bias member interconnecting the anti-slam member to the housing.

A second aspect of the invention contemplates a two-point mortise lock mechanism adapted for retrofitting in a mortise in which a single point mortise lock housing of first predetermined width, length, depth, and actuating member location dimensions was previously mounted, wherein the two-point lock comprises a lock housing having dimensions substantially identical to the first predetermined length, width, depth and actuating member location dimensions, and first and second locking members positioned within the housing, each having a first end and a hooked second end.

A third aspect of the invention contemplates a mortise locking system, comprising: a lock mechanism, comprising a lock housing adapted for secure positioning within a first mortise; first and second locking members positioned within the housing, each having a first end and a hooked second end; an actuator mounted for rotational movement within the housing and adapted for user directed rotational movement; a motion translating linkage having a first end pivotally interconnected to the first end of the first locking member, a second end pivotally interconnected to the first end of said second locking member, the motion translating linkage being interconnected to the actuating member and adapted for corresponding movement when the actuator is moved; and a first bias member interconnecting the translating linkage to the housing, whereby the bias member retains the actuator and the translating linkage in a first position absent user force directed to the actuator; and a keeper, comprising: a keeper housing adapted for secure positioning within a second mortise; and first and second inwardly directed shoulders laterally spaced from one another and adapted for engagement by the first and second hook ends, respectively.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 6:
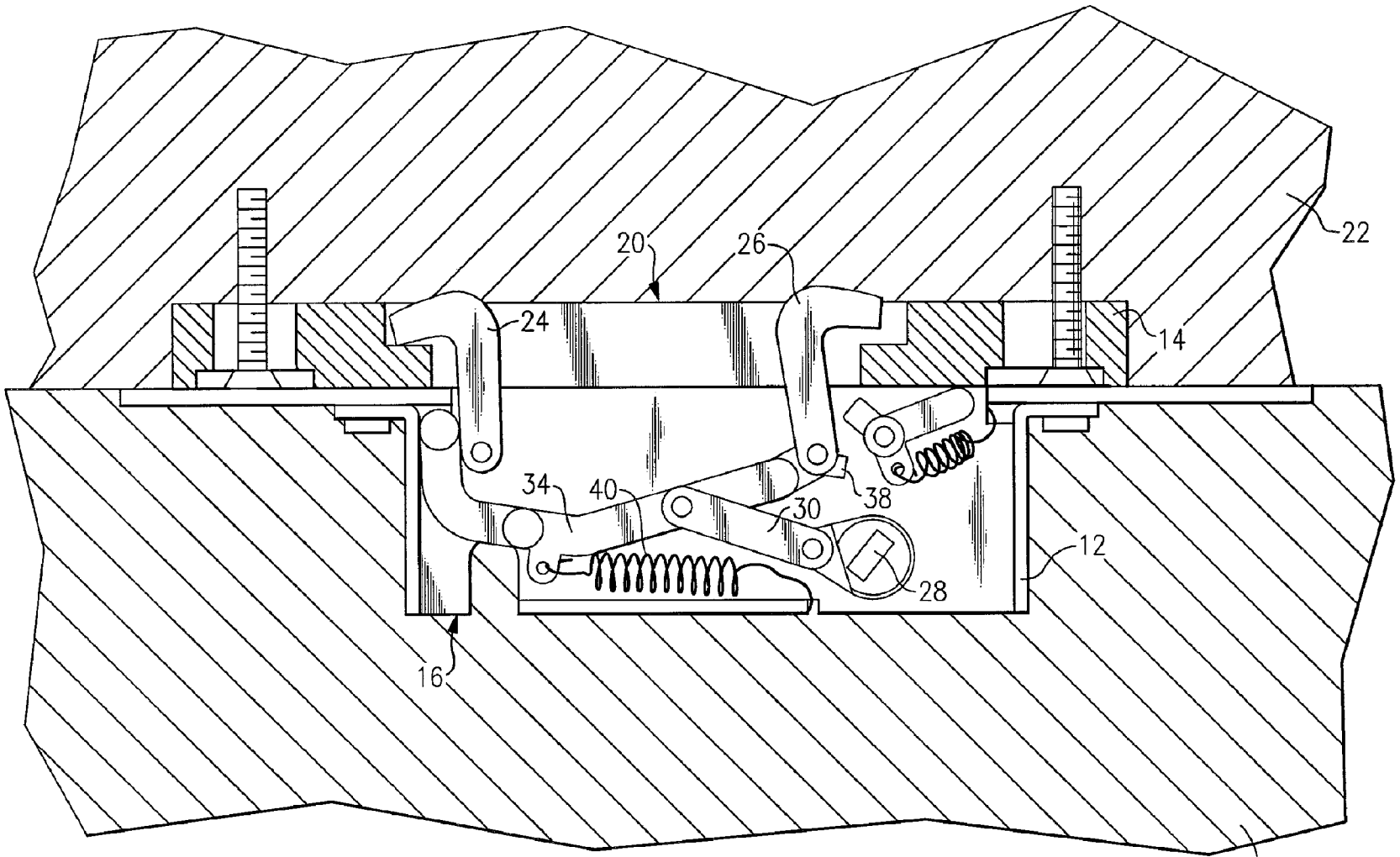
FIG. 6 is a cross-section view of the two-point mortise lock mounted in a door and with the hooks in their open, locked position.
Figure 7:
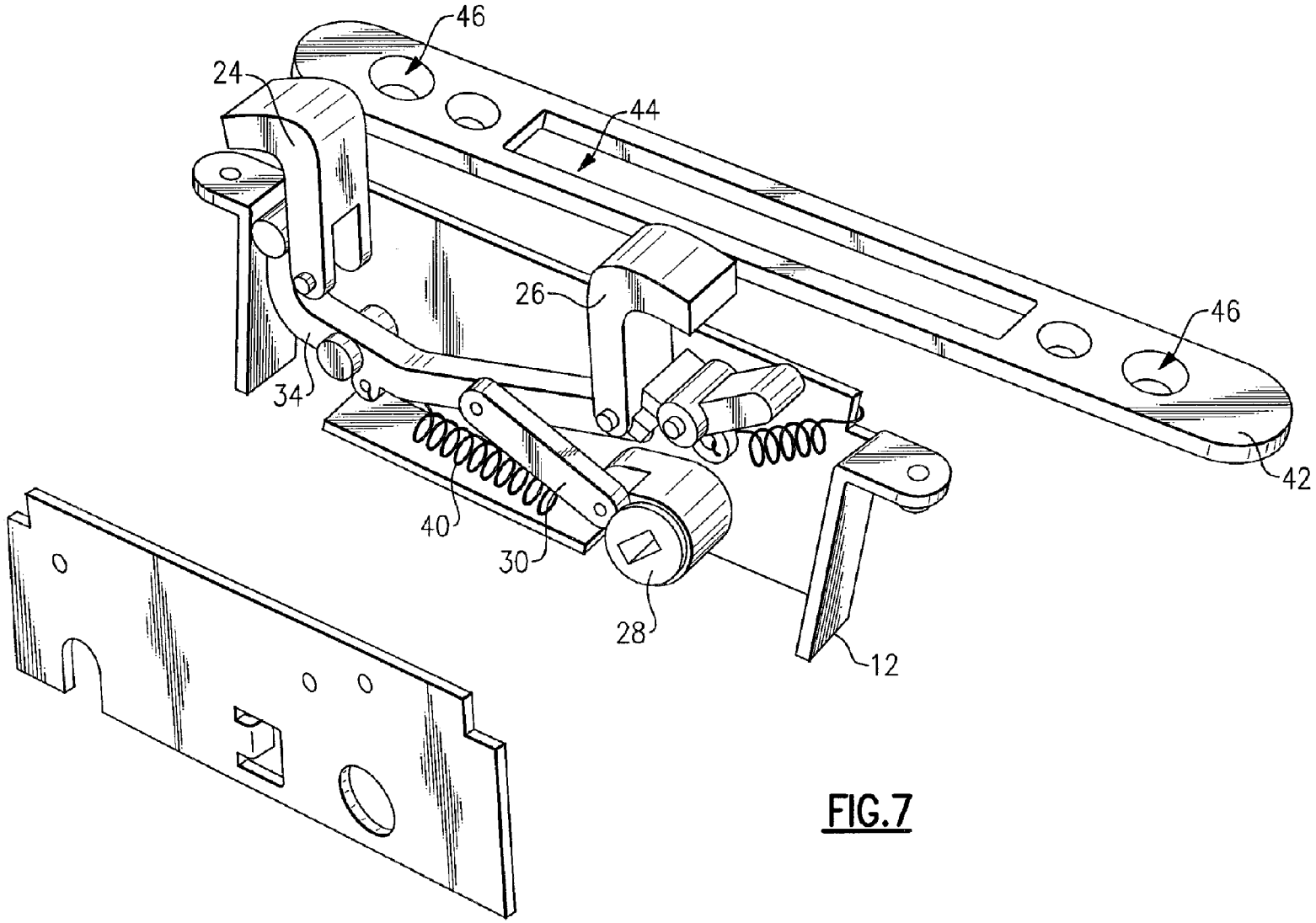
FIG. 7 is an exploded perspective view of the two-point lock.

Referring now to the drawings, there is seen in the Figures a two-point mortise lock assembly designated generally by reference numeral 10 essentially comprising a lock housing 12 and a lock keeper 14. Housing 12 is adapted for secure placement within a mortise 16 formed in the edge of a sliding door 18, while keeper 14 is adapted for secure positioning either within a mortise 20 formed in a door jamb 22 or directly to a door jamb 22 (see FIG. 6).

Figure 1A:
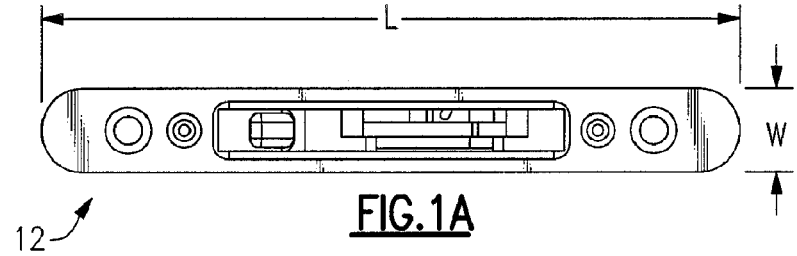
FIGS. 1A, 1B, and 1C are top, front, and side elevation views, respectively, of a two-point mortise lock according to the present invention.
Figure 1B:
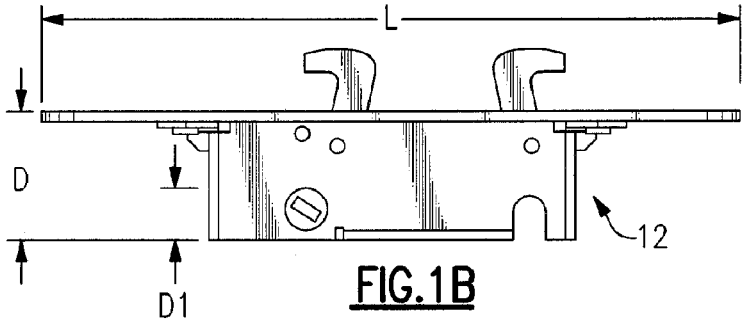
Figure 1C:
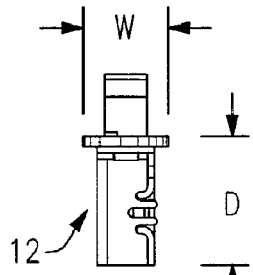
Figure 2A:
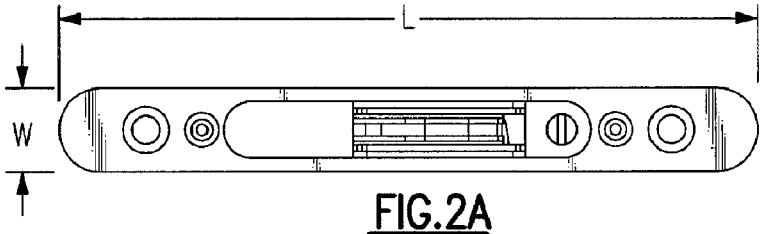
FIG.2A Prior Art
FIGS. 2A, 2B, and 2C are top, front, and side elevation views, respectively, of a prior art single point mortise lock.
Figure 2B:
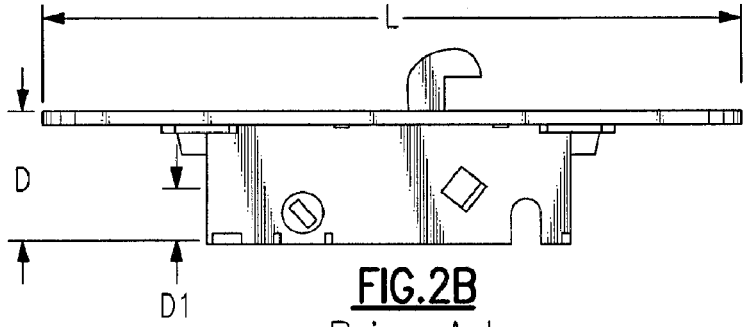
FIG.2B Prior Art
Figure 2C:
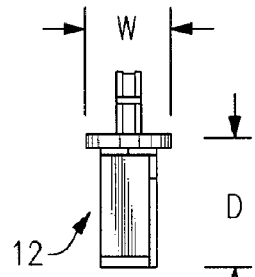
FIG.2C Prior Art
Figure 3:
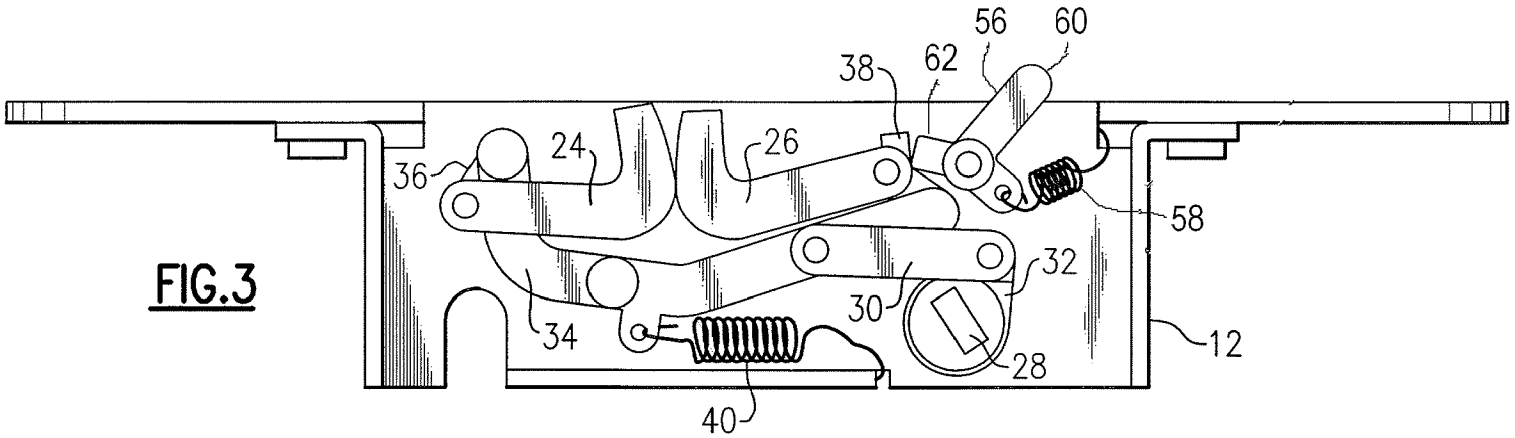
FIG. 3 is a front elevation of the two-point lock with the cover plate removed and with the two hooks in their closed position.
Figure 4:
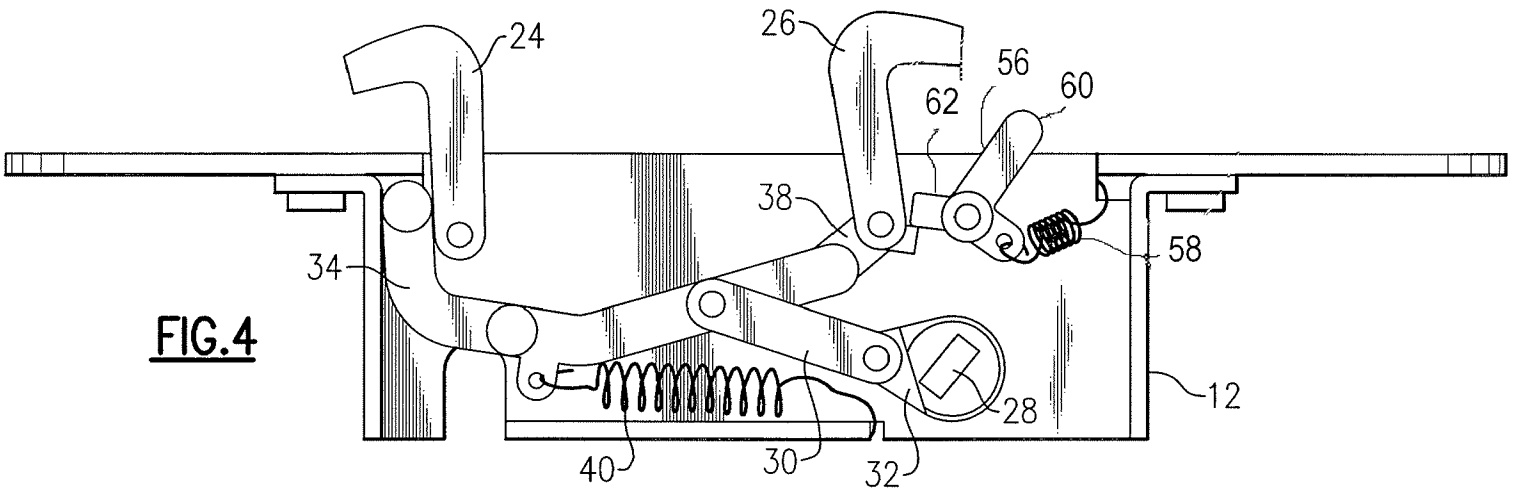
FIG. 4 is a front elevation of the two-point lock with the cover plate removed and with the two hooks in their open position.
Figure 5:
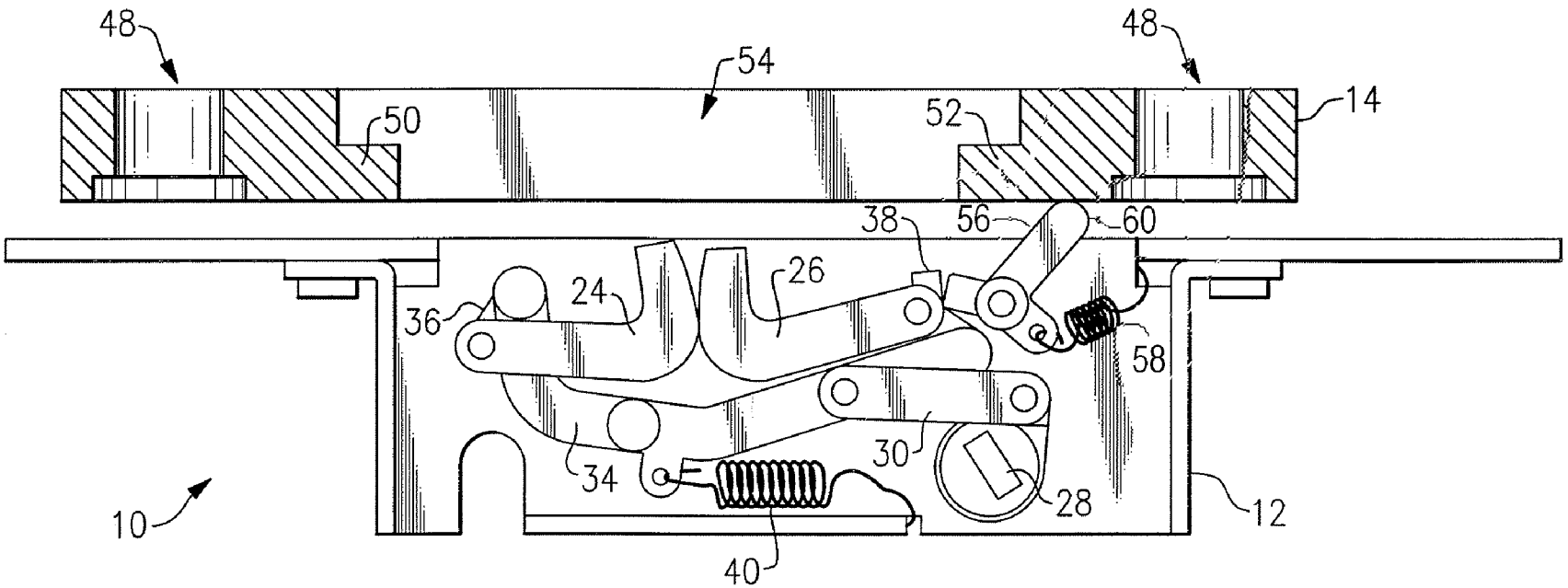
FIG. 5 is a front elevation of the two-point lock and keeper in cross-section with the cover plate of the lock removed and with the two hooks in their closed position.

With reference to FIGS. 3-7, housing 12 contains the essential elements of the lock, and has a length L, width W, and depth D that is substantially the same as the corresponding dimensions on a single point mortise lock shown in FIGS. 2A-2C. In particular, first and second locking members 24, 26 are pivotally mounted within housing 12, for simultaneous, pivotal movement in response to user induced, rotational movement of a keyed actuator 28 to which each of locking members 24 and 26 are interconnected. Actuator 28 is cam-shaped and an elongated actuator linkage 30 is pivotally connected at one end to the cammed end 32 of actuator 28, and the linkage's opposite end is connected at an intermediate position along a motion translating linkage 34. The opposing ends of motion translating linkage 34 are respectively interconnected to the non-hooked ends of locking members 24 and 26 via first and second hook linkages 36, 38, respectively, thereby completing the interconnection between locking members 24, 26 and actuator 28. Actuator 28 is positioned a distance D1 from the trailing edge of housing 12 that is substantially the same as distance D1 that the actuator on the one point lock of FIG. 2 is from the trailing edge of its housing.

A first bias member, or spring, 40 is interconnected between housing 12 and an intermediate position along motion translating linkage 34. Actuator linkage is attached to motion translating linkage at a position about midway between where bias member 40 is fastened thereto and its end to which second hook linkage 38 is interconnected. In positioning bias member 40 and actuator linkage 30 in this relation to one another on motion translating linkage 34, bias member 40 acts as an over-center spring with respect to actuator 28. In other words, once actuator 28 is rotated more than halfway between either of its terminal positions, bias member 40 automatically moves actuator 28 the rest of the way, thereby preventing lock members 24, 26 from remaining in any intermediate position, but rather always in either their fully open or fully closed positions.

A housing cover plate 42 is fastened with bolts or equivalent fasteners in covering relation to housing 12. Cover plate 42 includes an elongated opening 44 through which lock members 24, 26 can freely pass when moved via actuator 28. Cover plate 42 further includes mounting holes 46 through which a bolt may pass to connect housing 12 to door 18.

As described hereinbefore, keeper 14 is mounted within mortise 20 formed in door jamb 22. Keeper 14 generally comprises a pair of mounting holes 48 through which bolts may pass to connect keeper 14 to door jamb 22, and a pair of inwardly directed shoulders or ledges 50, 52 formed within keeper 14 on opposing sides of a central opening 54. Ledges 50, 52 are adapted to securely receive and retain lock members 24, 26, respectively, when the lock members are rotated into their locked position. When door 18 is closed and it is desired to lock it, a user can manually move actuator 28 to simultaneously rotate lock members 24, 26 out of housing 12 and into keeper 14. When moved to their fully locked positions, the hooked ends of lock members 24, 26 engage ledges 50, 52, respectively, thereby prohibiting sliding movement of door 18 away from door jamb 22.

An additional feature incorporated into lock 10 is an anti-slam mechanism 56 that is pivotally mounted within housing 12. Anti-slam mechanism 56 is interconnected in pivotally biased relation to housing 12 by a second bias member, or spring, 58. Bias member 58 causes the anti-slam mechanism's rounded end 60 to be positioned outside of housing 12 absent any external forces being applied to arm 60. When in the unlocked position, a flattened base end 62 of anti-slam mechanism 56 abuts/engages lock linkage 38, thereby prohibiting movement of locks 24, 26. Thus, when lock members are in unlocked positions, arm 60 remains outside of housing 12 and prohibits the lock members from being opened, thereby preventing any damage to the locks arising from the door being slammed.

When it is desired to close door 18 relative to jamb 22, anti-slam mechanism is forcibly moved when it is closed against door jamb 22, thereby moving flattened end 62 out of engagement with linkage 38, thereby permitting rotation of lock members 24, 26 to their locked positions.

What is claimed is:

1. A mortise lock mechanism, comprising:

a lock housing adapted for secure positioning within a mortise;

first and second locking members positioned within said housing, each having a first end and a hooked second end;

an actuator mounted for rotational movement within said housing and adapted for user directed rotational movement;

a motion translating linkage having a first end pivotally interconnected to said first end of said first locking member, a second end pivotally interconnected to said first end of said second locking member, said motion translating linkage being interconnected to said actuating member and adapted for corresponding movement when said actuator is moved; and a first bias member interconnecting said translating linkage to said housing, whereby said bias member retains said actuator and said translating linkage in a first position absent user force directed to said actuator.

2. The mortise lock of claim 1, farther comprising:

an anti-slam member mounted for pivotal movement within said housing; and a second bias member interconnecting said anti-slam member to said housing.

3. The mortise lock of claim 2, wherein said first bias member is a spring.

4. The mortise lock of claim 2, wherein said second bias member is a spring.

5. The mortise lock of claim 1, wherein said actuator comprises a cam.

6. The mortise lock of claim 1, further comprising an elongated actuator linkage positioned between said actuator and said motion translating linkage.

7. The mortise lock of claim 6, wherein said actuator linkage includes a first end securely connected to said actuator, and a second end securely connected to said motion translating linkage at an intermediate position therealong.

8. A two-point mortise lock mechanism for placement in a conventional mortise sized to accommodate a single-point mortise lock housing and that included a single point mortise lock with a first cam backset at a predetermined backset distance, comprising:

a lock housing having predetermined length, width, and depth dimensions that are adapted for retro-fitting in the space of the conventional mortise sized to accommodate a single point mortise lock housing, wherein said predetermined length is 3¼ inches; and first and second locking members positioned for pivotal movement within said housing, each having a first end and a hooked second end.

9. The two-point mortise lock of claim 8, wherein said first predetermined width is 1⅛ inches.

10. The two-point mortise lock of claim 8, wherein said first predetermined depth is ½ inch.

11. The two-point mortise lock of claim 8, further comprising a cam positioned within said housing at a backset distance substantially identical to said predetermined backset distance.

12. The two-point mortise lock of claim 11, wherein said predetermined backset distance is about ¾ inch.

13. A mortise locking system, comprising:

a lock mechanism, comprising:

a lock housing adapted for secure positioning within a first mortise;

first and second locking members positioned within said housing, each having a first end and a hooked second end;

an actuator mounted for rotational movement within said housing and adapted for user directed rotational movement;

a motion translating linkage having a first end pivotally interconnected to said first end of said first locking member, a second end pivotally interconnected to said first end of said second locking member, said motion translating linkage being interconnected to said actuating member and adapted for corresponding movement when said actuator is moved; and a first bias member interconnecting said translating linkage to said housing, whereby said bias member retains said actuator and said translating linkage in a first position absent user force directed to said actuator; and a keeper adapted for engagement by said first and second hook ends, respectively.

14. The mortise lock system of claim 13, wherein said lock mechanism further comprises:

an anti-slam member mounted for pivotal movement within said housing; and a second bias member interconnecting said anti-slam member to said housing.

15. The mortise lock system of claim 14, wherein said first bias members is a spring.

16. The mortise lock system of claim 14, wherein said second bias members is a spring.

17. The mortise lock system of claim 13, wherein said actuator comprises a cam.

18. The mortise lock system of claim 13, further comprising an elongated actuator linkage positioned between said actuator and said motion translating linkage.

19. The mortise lock of claim 18, wherein said actuator linkage includes a first end securely connected to said actuator, and a second end securely connected to said motion translating linkage at an intermediate position therealong.

20. A two-point mortise lock mechanism for placement in a conventional mortise sized to accommodate a single-point mortise lock housing and that included a single point mortise lock with a first cam backset at a predetermined backset distance, comprising:

a lock housing having a predetermined length, a width of about 1⅛ inches, and a predetermined depth dimensions, and adapted for retro-fitting in the space of the conventional mortise sized to accommodate a single point mortise lock housing; and first and second locking members positioned for pivotal movement within said housing, each having a first end and a hooked second end.

21. A two-point mortise lock mechanism for placement in a conventional mortise sized to accommodate a single-point mortise lock housing and that included a single point mortise lock with a first cam backset at a predetermined backset distance, comprising:

a lock housing having predetermined length and width dimensions, and a depth of about a ½ inch, and adapted for retro-fitting in the space of the conventional mortise sized to accommodate a single point mortise lock housing; and first and second locking members positioned for pivotal movement within said housing, each having a first end and a hooked second end.

* * * * *